US005755281A

United States Patent [19]

Kang et al.

[11] Patent Number: 5,755,281

[45] Date of Patent: May 26, 1998

[54] FIN TUBE HEAT EXCHANGER

[75] Inventors: Tae Wook Kang; Kam Gyu Lee, both of Busan, Rep. of Korea

[73] Assignee: LG Electronics Inc., Seoul, Rep. of Korea

[21] Appl. No.: 590,322

[22] Filed: Jan. 23, 1996

[30] Foreign Application Priority Data

| | | | |
|---|---|---|---|
| Jan. 23, 1995 | [KR] | Rep. of Korea | 1995-1110 |
| Aug. 5, 1995 | [KR] | Rep. of Korea | 1995-24235 |

[51] Int. Cl.[6] ..... F28D 1/04

[52] U.S. Cl. ..... 165/151; 165/181

[58] Field of Search ..... 165/151, 181, 165/182

[56] References Cited

U.S. PATENT DOCUMENTS

| | | | |
|---|---|---|---|
| 4,593,756 | 6/1986 | Itoh et al. | 165/151 |
| 4,723,599 | 2/1988 | Hanson | 165/151 |
| 4,907,646 | 3/1990 | Aoyagi et al. | 165/151 |
| 5,042,576 | 8/1991 | Broadbent | 165/151 |
| 5,099,914 | 3/1992 | Reifel | 165/151 |
| 5,109,919 | 5/1992 | Sakuma et al. | 165/151 |
| 5,360,060 | 11/1994 | Tanaka et al. | 165/151 |
| 5,509,469 | 4/1996 | Obosu | 165/151 |

FOREIGN PATENT DOCUMENTS

| | | | |
|---|---|---|---|
| 61-6590 | 1/1986 | Japan | 165/151 |
| 62-194194 | 8/1987 | Japan | 165/151 |
| 115695 | 4/1990 | Japan | 165/151 |
| 171596 | 7/1990 | Japan | 165/151 |
| 195892 | 8/1991 | Japan | 165/151 |
| 93595 | 3/1992 | Japan | 165/151 |

*Primary Examiner*—Leonard R. Leo

[57] ABSTRACT

A fin tube heat exchanger includes a plurality of fin plates spaced at regular intervals in parallel with one another and adapted to allow air to flow therebetween, each fin plate having a plurality of through-holes in at least one row in a longitudinal direction of the fin plates, a plurality of refrigerant tubes inserted into the through-holes of the fin plates in a perpendicular direction and a plurality of raised strips formed in a plurality of rows in a direction perpendicular to an air flow. The raised strips in the same row are raised from a fin base in a direction opposite to the direction in which the raised strips in adjacent rows are raised. The fin base and each of the raised strips define therebetween two openings open against the air flow. Rising portions on the refrigerant tube side of the raised strips in one row near to a center line of the through-holes are formed along a circular arc which has an identical center with the refrigerant tube. Rising portions on the refrigerant tube side of the raised strips in another row near to a longitudinal fin edge are formed along an outer tangential line of the circular arc. The number of the raised strips in another row near to the longitudinal fin edge is more than the number of the raised strips in one row near to the center line of the through-holes.

16 Claims, 9 Drawing Sheets

FIN TUBE HEAT EXCHANGER

BACKGROUND OF THE INVENTION

The present invention relates to a fin tube heat exchanger used in an air conditioner for exchanging heat between two fluids, for example, between refrigerant and air or the like.

Recently, since a tin tube heat exchanger is employed in air conditioners which tend to be reduced in size or to be thin, and therefore, there has been an increased demand for higher performance thereof.

FIG. 1 shows a conventional fin tube heat exchanger.

As shown in FIG. 1, a heat exchanger 10 is provided with a plurality a fin plates 20 or aluminum, spaced at regular intervals and a plurality of refrigerant tubes 30 extending through the fin plates 20. The refrigerant tubes 30 extending are securely held in openings formed in the fin plates 20 by any suitable means. Each fin plate 20 has a plurality of narrow cut-out strips extending across the direction of flow. These strips are raised from the plane in which the fin plate 20 lies for raising the heat exchanging performance.

FIGS. 2 and 3 show one of the conventional fin tube heat exchangers.

A plate-shaped fin, generally shown by 20, is provided with a plurality of fin collars 22 extending from a fin base and spaced from each other at regular intervals in the form of zigzag and a plurality of raised strips 24 formed between the collars 22 on the same face of the fin base as the fin collars 22 are formed. The raised strips 24 extend from the base plate up to the same height. A plurality of openings are defined between the fin base and the raised strips 24 to permit an air flow A to pass therethrough. The raised strips 24 exist beside the fin collars 22 formed in the shape of zigzag. A plurality of refrigerant tubes 30 extend through the fin collars 22 and are enlarged so as to be rigidly secured therein. Two tubes 30 are coupled to each other in the form of a figure "U" through a bend. When the air flow A passes between the tubes 30, an area 26 called "dead regions" upon which the air flow A hardly exerts any influence appears behind each tube 30 in a direction of the air flow A.

In the above described construction, all the raised strips 24 are of the same configuration and are aligned in several rows in the direction of the air flow A. Accordingly, since the distance between adjacent raised strips 24 is relatively small, they exert less influence upon the temperature boundary layer. Furthermore, rising portions **24*a* of the raised strips 24 are formed in a direction normal to a front edge of the fin plate 10. In addition, a side of the fin plate 20 which is opposite to the side on which the raised strips 24 are formed is a plane. Because of this, the raised strips 24 neither change the direction of the air flow A nor effectively turn it into turbulent flow. Thus, the dead regions 26 become large and this fact reduces an effective heat transfer area. Since the rising portions 24*a* of the raised strips 24** are formed one behind another in the direction of the air flow A, resistance against the flow in concentrated, with the result that it is impossible to uniformly distribute the velocity of air flow A, thereby inducing noise.

Japanese Patent Laid-open Publication No. 63-183391 discloses another configuration of raised strips as shown in FIG. 4A. The raised strips 24 in FIG. 4A are substantially in the pattern of an "X" as a whole. FIG. 4B is a wind velocity distribution diagram of the above-described heat exchanger wherein the size of arrows indicates the velocity or the air.

FIG. 5 shows a further conventional fin tube heat exchanger disclosers in Japanese patent Laid-open Publication No. 2-242022. In this case rising portions **24*a* of raised strips 24 are formed in a direction parallel with the direction of the air-flow A. In a small number of rows of outlet portion, the rising portions 24*a*** are inclined with respect to the direction of the air flow A.

In the above-described arrangement of the raised strips, however, the air flow whirls abruptly at the rising portions, **24*a* around the refrigerant tubes 30. Accordingly, the velocity or the air is reduced abruptly on the downstream side of the refrigerant tube 30** and the dead region hardly decreases (FIG. 4B).

SUMMARY OF THE INVENTION

It is an object of the present invention to provide a fin tube heat exchanger in which the dead region on the downstream side of the refrigerant tube is reduced, an effective heat transfer area becomes large and a heat exchanging performance is raised by arranging rising portions of raised strips along a circular arc and a tangential line thereof around a refrigerant tube.

In addition, the air flow is distributed effectively into the refrigerant tube and the raised strips of the fin plate according to the velocity of the air in order to increase heat transfer performance. Inclination angles on air flow inlet and outlet sides of the rising portions of the raised strips are controlled in order to reduce the dead region effectively by the air flow.

It is another object of the present invention to turn the air flow into turbulent flow, increase heat transfer performance and reduce noise by increasing gradually the number of the raised strips on the air flow outlet side. In order to achieve the above-mentioned objects, the fin tube heat exchanger according to the present invention includes a plurality of fin plates spaced at regular intervals in parallel with one another and adapted to allow air to flow therebetween each fin plate having a plurality of refrigerant tube inserted into the through-holes of the fin plates in a perpendicular direction and a plurality of raised strips formed in a plurality of rows in direction perpendicular to an air flow. The raised strips in the same row are raised from a fin base in a direction opposite to the direction in which the raised strips in adjacent rows are raised. The fin base and each row of the raised strips define therebetween two openings open against the air flow. Rising portions on a refrigerant tube side of the raised strips in one row near to a center line of the through-holes are formed along a circular arc which has an identical center with the refrigerant tube. Rising portions on the refrigerant tube side of the raised strips in another row near to a longitudinal fin edge are formed along an outer tangential line of the circular arc. The number of the raised strips in another row near to the longitudinal fin edge is more than the number of the raised strips in one row near to the center line of the through-holes.

According to another aspect of the present invention, the number of the raised strips in one row near to the center line of the through-holes is one, and the number of the raised strips in remaining rows is at more than one.

According to a further aspect of the present invention, at least one flat portion is formed between the raised strips in another row near to the longitudinal fin edge.

These and other objects of the present application will become more readily apparent from the detailed description given hereafter. However, it should be understood that the preferred embodiments of the invention are given by way of illustration only, since various changes and modification within the spirit in scope of the invention will become apparent to those skilled in the art from this detailed description.

DETAILED DESCRIPTION OF THE PREFERRED EMBODIMENTS

Preferred embodiments of the present invention are described in detail hereinafter by accompanying drawings.

Figure 1:
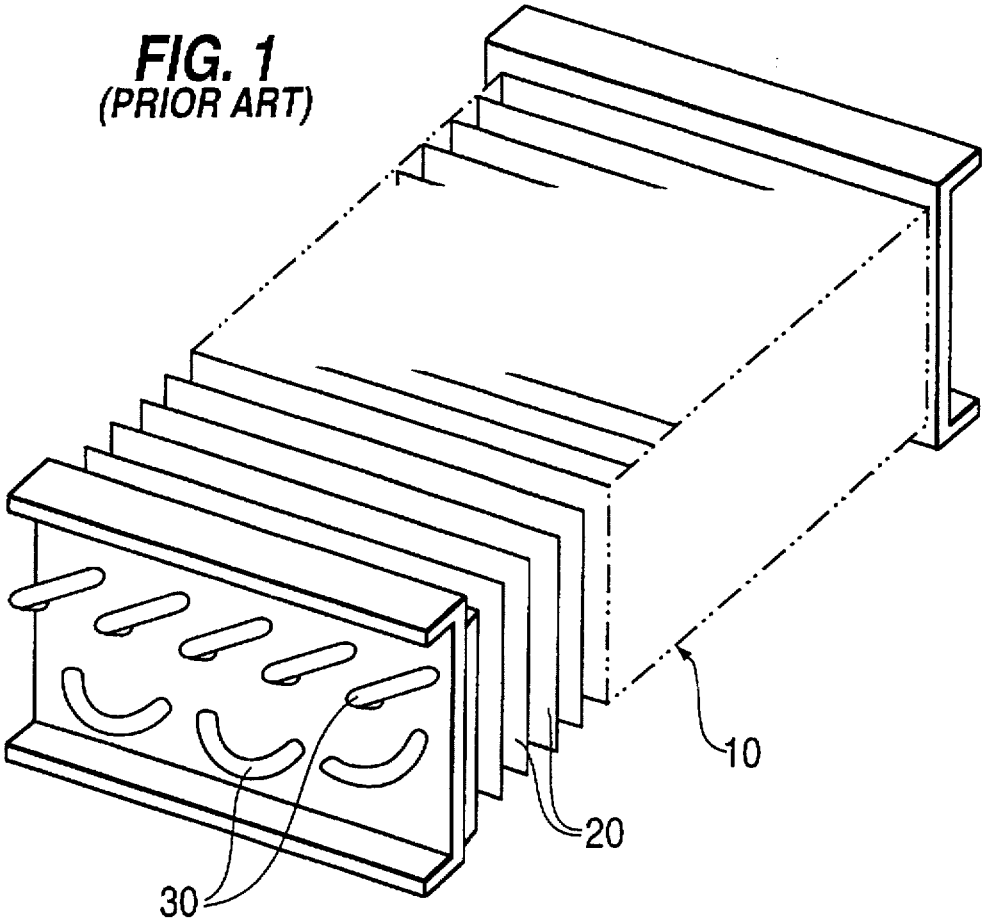
FIG. 1 (PRIOR ART)
FIG. 1 is a perspective view of a conventional fin tube heat exchanger.
Figure 2:
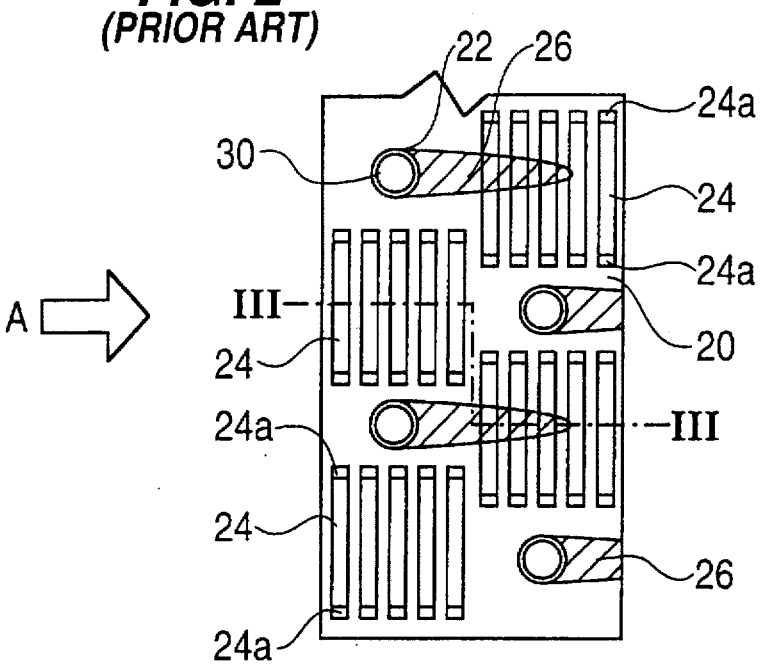
FIG. 2 (PRIOR ART)
FIG. 2 is a fragmentary front view of a conventional fin tube heat exchanger.
Figure 3:
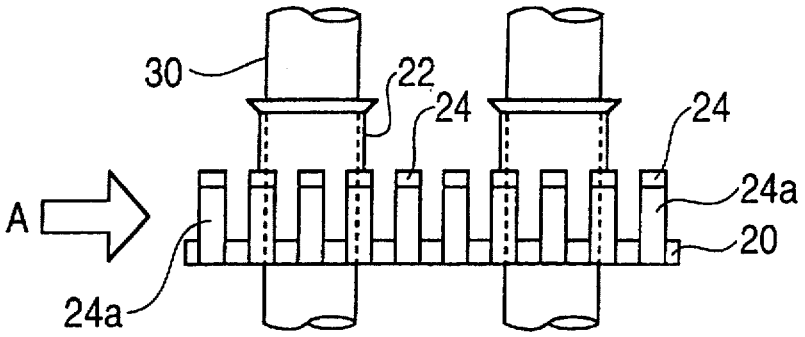
FIG. 3 (PRIOR ART)
FIG. 3 is a sectional view taken along the line III—III in FIG. 2.
Figure 4A:
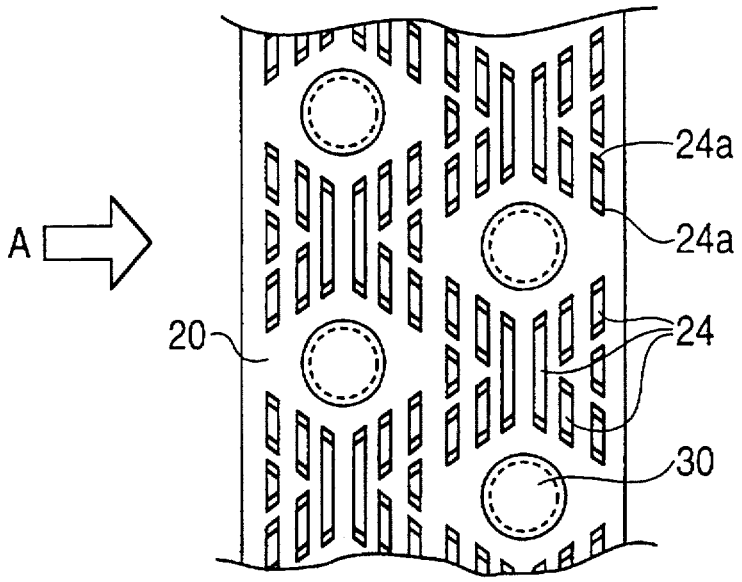
FIG. 4A (PRIOR ART)
FIGS. 4A and 4B are a fragmentary front view and conventional fin tube heat exchanger, respectively.
Figure 4B:
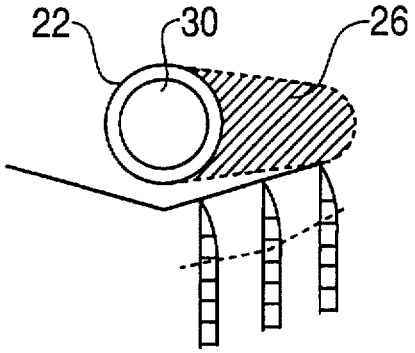
FIG. 4B (PRIOR ART)
Figure 5:
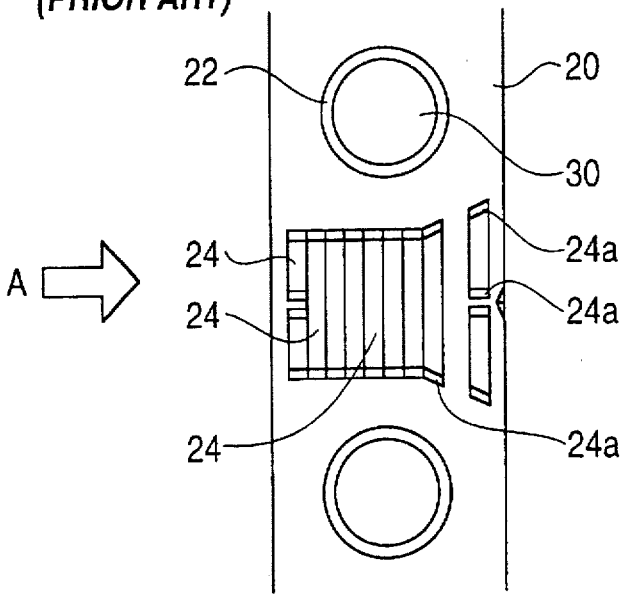
FIG. 5 (PRIOR ART)
FIG. 5 is a fragmentary front view of a further conventional fin tube heat exchanger.
Figure 6:
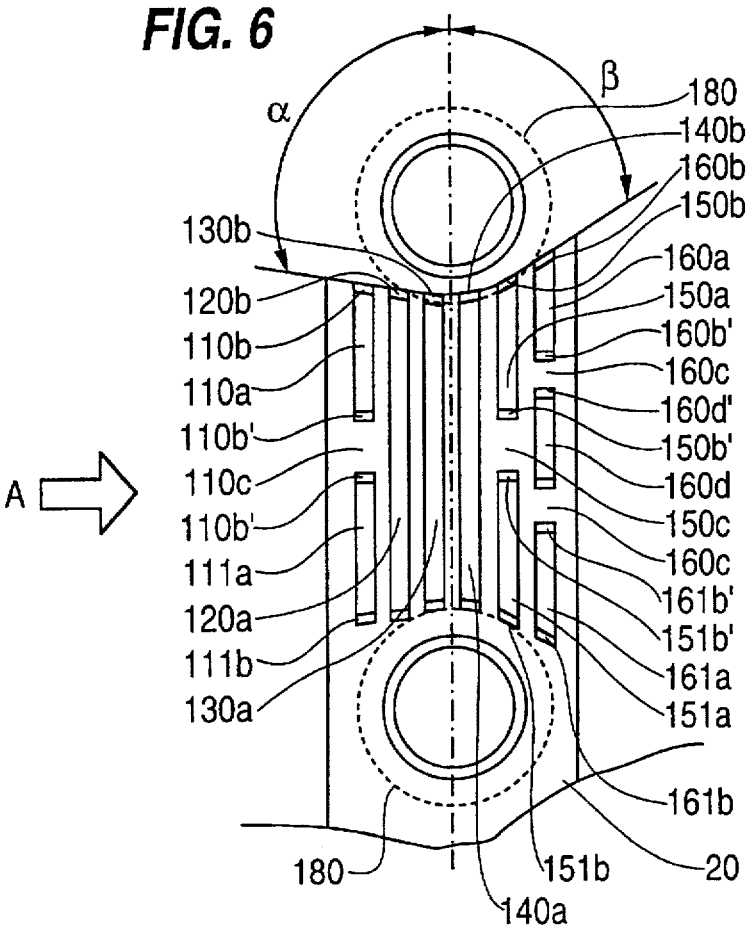
FIG. 6 is a fragmentary front view of a fin plate according to one embodiment of the present invention.

As shown in FIG. 6, refrigerant tubes 30 are inserted into fin collars 22 formed by burring in a tubular fin plate 20 at constant intervals, and an air flows in the direction of the arrows A.

The fin plate 20 has a group of raised strips comprising a total of six rows of raised strips, that is, three on the windward side and another three on the leeward side of the air flow A, between the two refrigerant tubes 2 that are arranged adjacent to each other in a direction perpendicular to the air flow A. Openings of the six rows of raised strips are perpendicular to the air flow A. Rising portions 130*b* and 140*b* of raised strips 130*a* and 140*a* in the third and the fourth rows are formed along a circular arc 180 which has an identical center with a refrigerant tube 30.

The raised strips in the first row comprise a pair of raised strips 110*a* and 111*a* separated by a central dividing flat portion 110*c*. The rising portions 110*b* and 111*b* on the refrigerant tube 30 side of the raised strips 110*a* and 111*a* in the first row are arranged so as to have their angles of inclination in a direction along the outer tangential line of the aforementioned circular arc 180. The raised strips in the second row comprise one raised strip 120*a*, and the rising portions 120*b* of the raised strips 120*a* in the second row are also arranged so as to have their angles of inclination in a direction along the outer tangential line of the aforementioned circular arc 180. The outer tangential line on the air flow inlet side is inclined by a predetermined angle α.

The raised strips in the fifth row comprise a pair of raised strips 150*a* and 151*a* separated by a central dividing flat portion 150*c*. The rising portions 150*b* and 151*b* on the refrigerant tube 30 side of the raised strips 150*a* and 151*a* in the fifth row are arranged so as to have their angles of inclination in a direction along the outer tangential line of the aforementioned circular arc 180.

The raised strips in the sixth row comprise three raised strips 160*a*, 160*d* and 161*a* separated by two small dividing flat portions 160*c*. The raised strip 160*d* in the form of rectangle is formed between two small dividing flat portions 160*c*, and the rising portions 160*d'* thereof are formed in a direction parallel with the direction of air flow A. The rising portions 160*b* and 161*b*, on the refrigerant tube 30 side of the raised strips 160*a* and 161*a* located on both sides of aforementioned raised strip 160*d*, are arranged so as to have their angles of inclination in a direction along the outer tangential line on the air flow outlet side of the above-mentioned circular arc 180. The outer tangential line on the air flow outlet side is inclined by a predetermined angle β. In addition, the raised strips in the six rows are formed alternately on the obverse and reverse sides of the fin plate 20 with each intermediate flat portion placed therebetween. On the other hand, rising portions 110*b*', 111*b*', 150*b*', 151*b*', 160*b* ' and 161*b*', on the central portion side of the raised strips 110*a*, 111*a*, 150*a*, 151*a*, 160*a* and 161*a* in the first, fifth and sixth rows, are formed in a direction parallel with the direction of air flow A.

Figure 7:
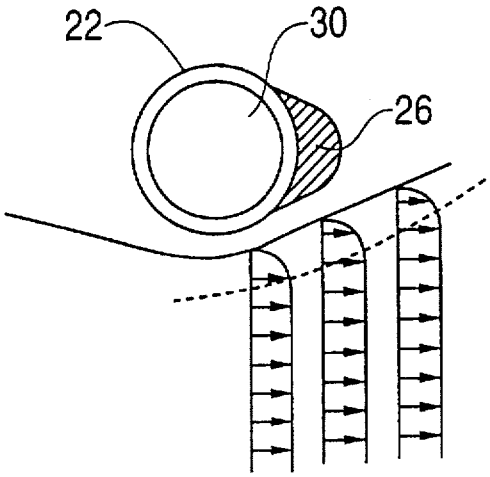
FIG. 7 is a diagram of distribution of wind velocity of the fin tube heat exchanger of the present invention.

In accordance with the above-describe arrangement, the raised strips in the six rows and intermediate flat portions therebetween show the effect of a front edge of a boundary layer, and the air flow is approximately divided into the refrigerant tube 30 and the fin plate 20 equally. In addition, the rising portions 140*b*, 150*b*, 151*b*, 160*b* and 161*b* on the refrigerant tube 30 side whirl the air flow and this fact reduces the dead region 26 on the downstream side of the in refrigerant tube 30 (FIG. 7). In other words, the rising portions arranged along the outer tangential line of the circular arc 180 whirl the air flow smoothly.

Figure 8A:
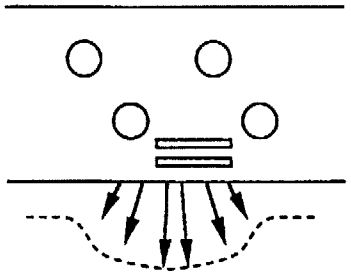
FIG. 8A (PRIOR ART)
FIG. 8A is a diagram of distribution of wind velocity in the group of raised strips shown in FIG. 2.
Figure 8B:
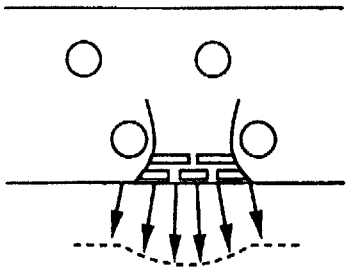
FIG. 8B is a diagram of distribution of wind velocity in the group of raised strips shown in FIG. 6.

In addition, as shown in FIGS. 8A and 8B, the velocity of the air in the heat exchanger of the present invention is more uniform than that of the conventional heat exchanger. That is, if the downstream-side pattern is made complicated due to increased raised strips number as shown in FIG. 8B, the difference in the wind velocity distribution can be kept to a small level by means of the raised strips on the side of the lowermost stream, so that the noise can be reduced.

In addition, the flat portions 110*c*, 150*c* and 160*c* in the first, fifth and sixth rows of the fin plate 20 are located, so that fin plate can be raised in strength during working and bending operation of the heat exchanger.

The present invention shows the same effect in the case where the refrigerant tubes are arranged in two rows in the direction of the air flow.

Figure 9:
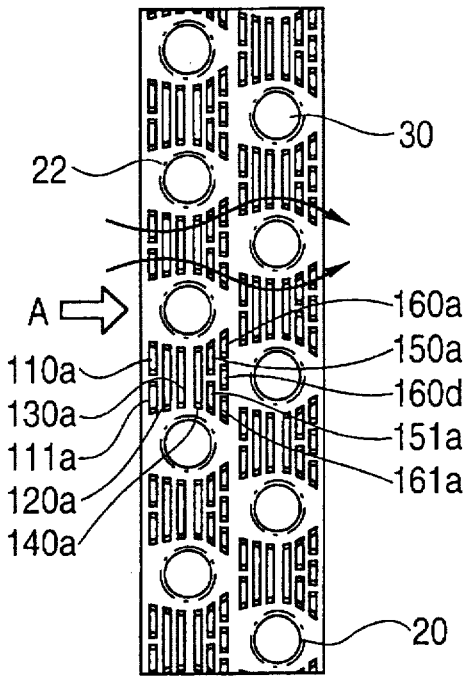
FIG. 9 is a front view of a fin plate mounted in a fin tube heat exchanger of according to one example of the present invention.

As shown in FIG. 9, the fin plate 20 is divided into an upstream-side row portion and a downstream-side row portion with a center line L serving as a boundary therebetween. There are provided fin collars 22 which the refrigerant tubes 30 penetrate in the respective row in portions. These fin collars 22 are arranged in such a manner that the upstream-side rows and the downstream-side rows do not overlap in the direction of the air flow A.

In the upstream-side row, the raised strips formed between the refrigerant tubes 30 are the raised strips 110*a*, 111*a*, 120*a*, 130*a*, 140*a*, 150*a*, 151*a*, 160*a*, 160*d* and 161*a* shown in FIG.6, the raised strips in the upstream-side row are duplicated in the downstream-side row.

In the case where the refrigerant tubes are arranged in two rows as described above, the air flows through the raised strips in the direction of arrows in FIG. 9.

Figure 10A:
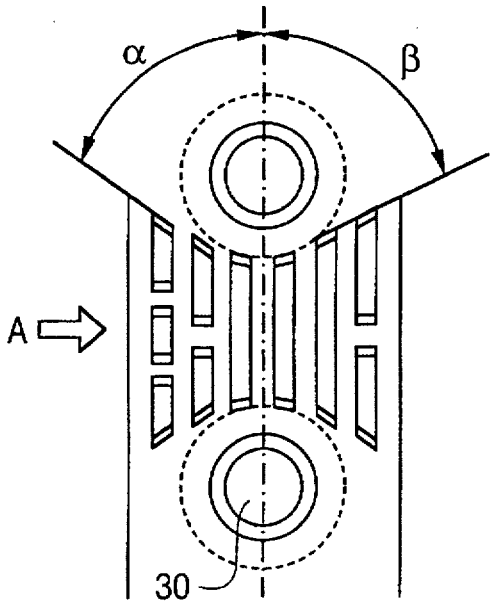
FIGS. 10A and 10B are fragmentary front views of fin plates according to other embodiments of the present invention.
Figure 10B:
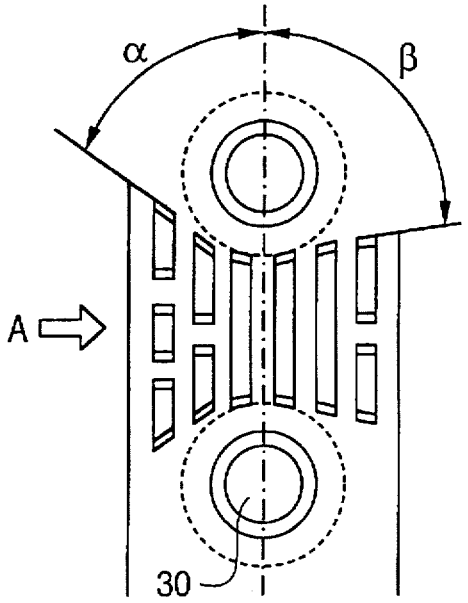

FIGS. 10A and 10B show other embodiments of the present invention.

In the embodiment of FIG. 10A, the inclination angle α on the air flow inlet side is identical with the inclination angle β on the air flow outlet side. The three rows on the upstream-side and the three rows on the downstream-side in FIG. 6 are changed with a center line of the refrigerant tube as a boundary therebetween.

In the embodiment of FIG. 10B, the inclination angle α on the air flow inlet side is smaller than the inclination angle β on the air flow outlet side. The pattern of raised strips is identical with that of the raised strips in FIG. 10A.

In the above described construction, the air flow is distributed effectively into the refrigerant tube and the raised strips of the fin plate by controlling the inclination angles on the air flow inlet and outlet sides according to the velocity of the air. The air flow whirls to the refrigerant tube by the rising portions on the refrigerant tube side, so that the dead region on the downstream of the refrigerant tube is reduced and the effective heat transfer area is increased.

In addition, the number of raised strips on the air flow inlet side is smaller than that of raised strips on the air flow outlet side with a center line of the refrigerant tube serving as a boundary therebetween, so that water drops flow down smoothly when used as an evaporator.

Figure 11B:
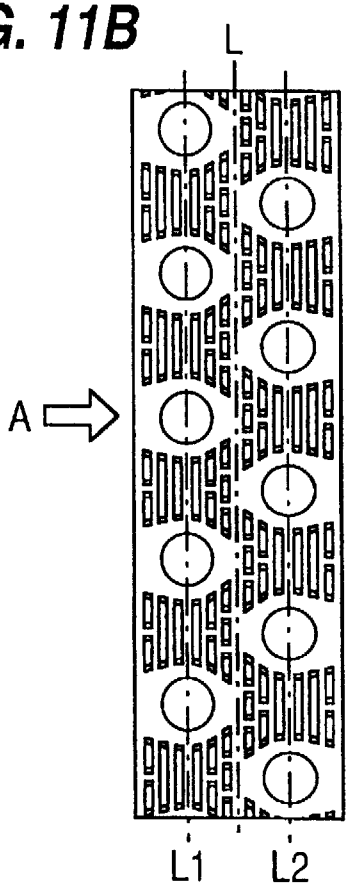
FIGS. 11A and 11B are front views of fin plates mounted in a fin tube heat exchanger according to other examples of the present invention.
Figure 11A:
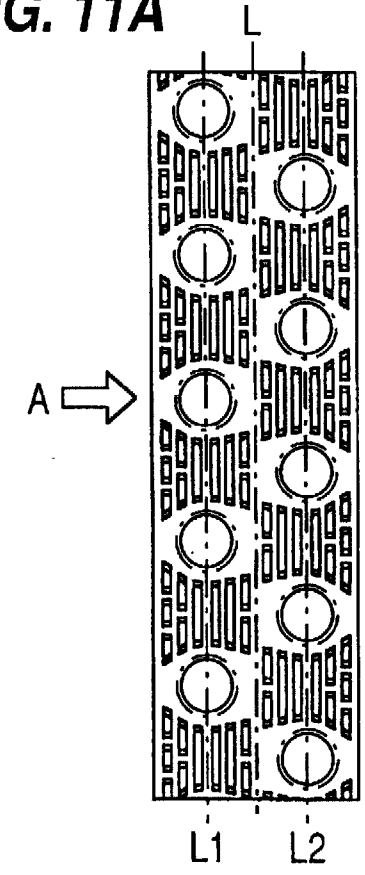

FIGS. 11A and 11B show fin plates mounted in a fin tube heat exchanger according to other examples of the present invention.

The example of FIG. 11A show a fin plate mounted in a heat exchanger used in an evaporator.

In the example shown in FIG. 11A, the refrigerant tubes are arranged in two rows in the direction of the air flow. The fin plate is divided into an upstream-side row portion and a downstream-side row portion with a center line L as a boundary therebetween. The pattern of raised strips on the upstream side is identical with that of the raised strips shown in FIG. 10B. The pattern of raised strips on the downstream side is identical with that of the raised strips shown in FIG. 6. Since a lot of water drops are generated in an area between a center line L1 of the refrigerant tube on the air flow inlet side and a center line L2 of the refrigerant tube on the air flow outlet side where heat is transferred intensively, the number of the raised strips in this area is lowered. That is, the number of the raised strips formed between the center line L1 of the refrigerant tube on the air flow inlet side and the center line L2 of the refrigerant tube on the air flow outlet side is less than that of remaining raised strips located near edges of the fin plate, thereby the water drops flow smoothly.

The example of FIG. 11B show a fin plate mounted in a heat exchanger used in a condenser.

As shown in FIG. 11B, the pattern of raised strips on the upstream side is identical with that of the raised strips shown in FIG. 6, and the pattern of raised strips on the downstream side is identical with that of the raised strips shown in FIG. 10B. Since water drops are not generated when the heat exchanger is used as an condenser, the number of the raised strips in an area between a center line L1 of the refrigerant tube on the air flow inlet side and a center line L2 of the refrigerant tube on the air flow outlet side where heat is transferred intensively, is more than that of remaining raised strips.

Figure 12A:
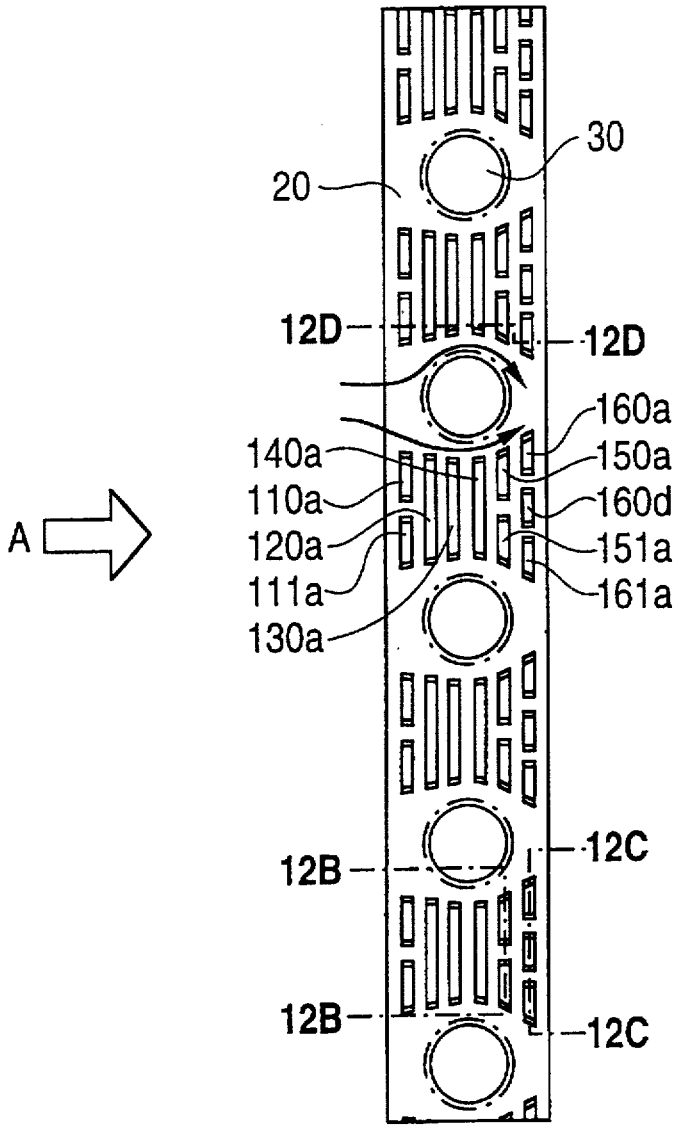
FIG. 12A is a front view of a fin plate in FIG. 6 mounted in a fin tube heat exchanger.

FIG. 12A is a front view of a fin plate in FIG. 6 mounted in a fin tube heat exchanger.

Figure 12B:
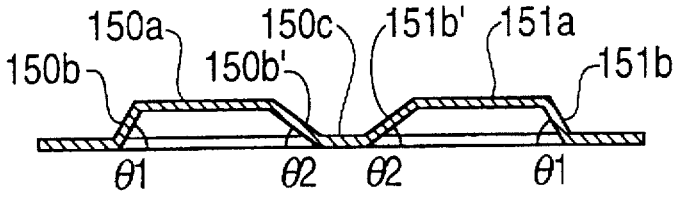
FIGS. 12B, 12C, 12D are sectional views taken along the lines 12B—12B, 12C—12C and 12D—12D in FIG. 12A, respectively.
Figure 12C:
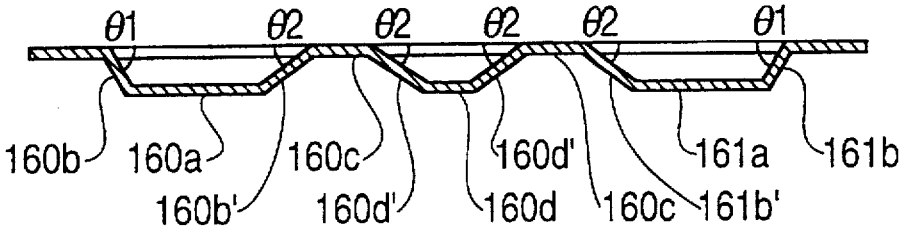
Figure 12D:
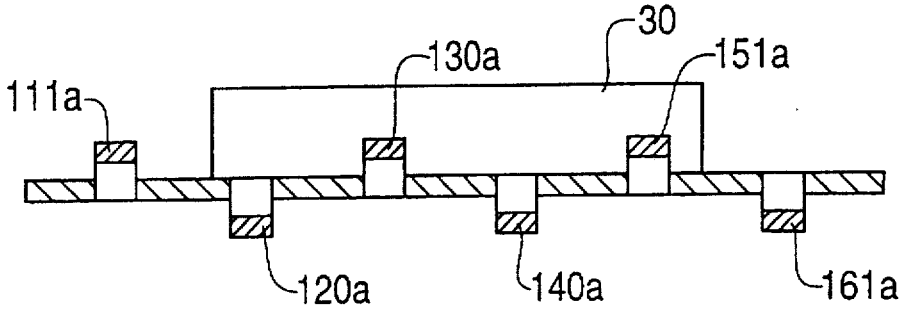

FIGS. 12B, 12C, 12D are sectional views taken along the lines 12B—12B, 12C—12C and 12D—12D in FIG. 12A, respectively.

As shown in FIG. 12D, the six rows of the raised strips are formed alternately on the obverse and reverse sides of the fin plate 20.

As shown in FIG. 12B, the rising portions 150*b* and 151*b* on the refrigerant tube 30 side of the raised strips 150*a* and 151*a* in the fifth row are inclined by an angle θ1 within the range of 35–420. On the other hand, the rising portions 150*b*' and 151*b*' on the central portion side are inclined by an angle θ2 within the range of 27°–35°.

As shown in FIG. 12C, the rising portions 160*b* and 161*b* on the refrigerant tube 30 side of the raised strips 160*a* and 161*a* in the sixth row are inclined by an angle θ1 within the range of 35°–42°. On the other hand, the rising portions 160*b*', 160*d*' and 161*b*' on the central portion side are inclined by an angle θ2 within the range of 27°–35°.

That is, since the inclination angle θ2 of the rising portions on the central portion side are smaller than that θ1 of the rising portions on the refrigerant tube side, high-speed raised strip working becomes possible.

In addition, the inclination angle of the rising portions is smaller than the inclination angle of the conventional rising portions, namely, 45°, so that the water drops flow down smoothly.

While specific embodiments of the invention have been illustrated and described wherein, it is to realize that modifications and changes will occur to those skilled in the art. It is therefore to be understood that the appended claims are intended to cover all modifications and changes as fall within the true spirit and scope of the invention.

What is claimed is:

1. A fin tube heat exchanger comprising:

a plurality of fin plates spaced at regular intervals in parallel with one another and adapted to allow air to flow therebetween, each fin plate having a plurality of through-holes in at least one row in a longitudinal direction of said fin plates; a plurality of refrigerant tubes inserted into said through-holes of said fin plates in a perpendicular direction; and a plurality of raised strips formed in a plurality of rows in a direction perpendicular to an air flow, said raised strips in a same row being raised from a fin base in a direction opposite to the direction in which said raised strips in adjacent rows are raised, said fin base and each of said raised strips defining therebetween two openings open against the air flow, rising portions of said raised strips on a refrigerant tube side in rows near to a center line of said through-holes defining a circular arc which is asymmetrical with respect to said center line, rising portions on said refrigerant tube side of said raised strips in rows near to either a windward longitudinal fin edge or a leeward longitudinal fin edge being formed along an outer tangential line of said circular arc, a number of said raised strips in either row near to said windward or leeward longitudinal fin edge being more than a number of said raised strips on said rows near to said center line of said through-holes; and wherein the number of raised strips on said windward longitudinal fin edge of said refrigerant tube is different from the number of raised strips on said leeward longitudinal fin edge of said refrigerant tube.

2. The fin tube heat exchanger according to claim 1, wherein the number of said raised strips in rows near to said center line of said through-holes is one, and the number of said raised strips in remaining rows is at least one.

3. The fin tube heat exchanger according to claim 1, wherein at least one flat portion is formed between raised strips in a row near to said windward or leeward longitudinal fin edge.

4. The fin tube heat exchanger according to claim 1, wherein an inclination angle of the rising portions of said raised strips is smaller than 45 degrees.

5. The fin tube heat exchanger according to claim 1, wherein said through-holes are formed in two rows, and the number of said raised strips formed between center lines of said two rows of said through-holes is less than the number of remaining raised strips.

6. The fin tube heat exchanger according to claim 1, wherein said through-holes are formed in two rows, and the number of said raised strips formed between center lines of said two rows of said through-holes is more than the number of remaining raised strips.

7. A fin tube had exchanger comprising:

a plurality of fin plates spaced at regular intervals in parallel with one another and adapted to allow air to flow therebetween, each fin plate having a plurality of through-holes in at least one row in a longitudinal direction of said fin plates;

a plurality of refrigerant tubes inserted into said through-holes of said fin plates in a perpendicular direction; and a plurality of raised strips formed in a plurality of rows in a direction perpendicular to an air flow, said raised strips in a same row being raised from a fin base in a direction opposite to the direction in which said raised strips in adjacent rows are raised, said fin base and each of said raised strips defining therebetween two openings open against the air flow, rising portions of said raised strips on a refrigerant tube side in rows near to a center line of said through-holes defining a circular arc which is asymmetrical with respect to said center line, rising portions on said refrigerant tube side of said raised strips in rows near to either a windward longitudinal fin edge or a leeward longitudinal fin edge being formed along an outer tangential line with respect to the air flow direction of said circular arc, a number of said raised strips in either row near to said windward or leeward longitudinal fin edge being more than a number of said raised strips on said rows near to said center line of said through-holes; and wherein an inclination angle with respect to a plane of each of said fin plates of the rising portions of said raised strips is smaller than 45 degrees and said inclination angle of said rising portions being associated with rows of strips having more than one strip on a central portion side is smaller than said inclination angle of said rising portions on said refrigerant tube side.

8. A fin tube heat exchanger according to claim 7, wherein said inclination angle of said rising portions on said refrigerant tube side is 35 to 42 degrees, and said inclination angle of said rising portions on said central portion side is approximately 27 to 35 degrees.

9. A fin tube heat exchanger comprising:

a plurality of fin plates having a plurality of through-holes in at least one row in a longitudinal direction of said fin plates;

a plurality of refrigerant tubes inserted into said through-holes of said fin plates in a perpendicular direction;

a plurality of raised strips being raised from a base fin formed in a plurality of rows between the refrigerant tubes, each raised strip having rising portions; and wherein a number of raised strips on a windward side of an airflow between the refrigerant tubes is different from a number of raised strips on a leeward side of the airflow between the refrigerant tubes, rising portions of said raised strips on a refrigerant tube side in rows near to a center line of said through-holes defining a circular arc which is asymmetrical with respect to said center line and an inclination angle of said windward side of said circular arc where rising portions are formed is different from an inclination angle of a leeward side of said circular arc where rising portions are formed.

10. The fin tube heat exchanger according to claim 9, wherein said raised strips comprise a total of six rows between said refrigerant tubes.

11. The fin tube heat exchanger according to claim 10, wherein between two refrigerant tubes three rows of said raised strips are on the windward side and three rows of said raised strips are on the leeward side of an air flow between the two refrigerant tubes.

12. The fin tube heat exchanger according to claim 11, wherein the number of raised strips in a first row on said windward side has a different number of raised strips than a sixth row on said leeward side.

13. The fin tube heat exchanger according to claim 11, wherein the number of raised strips in a second row on said windward side has a different number of raised strips than a fifth row on said leeward side.

14. The fin tube heat exchanger according to claim 11, wherein there are an equal number of raised strips in a third row on said windward side and fourth row on said leeward side.

15. A fin tube heat exchanger usable as an evaporator comprising:

a plurality of fin plates having a plurality of through-holes, each fin plate being divided into an upstream-side row portion and a downstream-side row portion with a boundary line therebetween;

a plurality of refrigerant tubes inserted into said through-holes of said fin plates, said refrigerant tubes being arranged in said upstream-side row portion and said downstream-side row portion of said fin plate; and a plurality of strips having rising portions raised from a base fin arranged in a set pattern between refrigerant tubes, said set pattern having more strips along a longitudinal edge of a refrigerant tube than a number of strips near a center line of said through-holes, said raising portions defining a circular arc which is asymmetrical with respect to said center line, wherein a pattern of the strips on the upstream-side row portion is identical with a pattern of the strips on the downward-side row portion.

16. A fin tube heat exchanger useable as an condenser comprising:

a plurality of fin plates having a plurality of through-holes, each fin plate being divided into an upstream-side row portion and a downstream-side row portion with a boundary line therebetween;

a plurality of refrigerant tubes inserted into said through-holes of said fin plates, said refrigerant tubes being arranged in said upstream-side row portion and said downstream-side row portion of said fin plate; and a plurality of strips having rising portions raised from a base fin arranged in a set pattern between the refrigerant tubes, said set pattern having more strips along a longitudinal edge of a refrigerant tube than a number of strips near a center line of said through-holes, said rising portions defining a circular arc which is asymmetrical with respect to said center line, wherein a pattern of the strips on the upstream-side row portion is asymmetrical with a pattern of the strips on the downward-side row portion.

* * * * *